US007219796B2

(12) United States Patent
Anderson

(10) Patent No.: US 7,219,796 B2
(45) Date of Patent: May 22, 2007

(54) DISPENSING CAPSULE FOR A LIQUID CONTAINER

(75) Inventor: Michael R. Anderson, Boca Raton, FL (US)

(73) Assignee: Vision International Production, Inc., Boca Raton, FL (US)

( * ) Notice: Subject to any disclaimer, the term of this patent is extended or adjusted under 35 U.S.C. 154(b) by 352 days.

(21) Appl. No.: 10/605,873

(22) Filed: Nov. 3, 2003

(65) Prior Publication Data

US 2004/0104247 A1 Jun. 3, 2004

Related U.S. Application Data

(63) Continuation-in-part of application No. 10/155,461, filed on May 24, 2002, now Pat. No. 6,644,471.

(51) Int. Cl.
*B65D 25/08* (2006.01)

(52) U.S. Cl. ..... 206/222; 206/219

(58) Field of Classification Search ..... 206/219–222, 206/568; 215/251–254, DIG. 8
See application file for complete search history.

(56) References Cited

U.S. PATENT DOCUMENTS 1,774,258 A * 8/1930 English ..... 206/222
3,156,369 A * 11/1964 Bowes et al. ..... 206/222
3,968,872 A * 7/1976 Cavazza ..... 206/222
4,195,731 A * 4/1980 Cavazza ..... 206/222
4,591,050 A * 5/1986 Finke et al. ..... 206/222
5,029,718 A * 7/1991 Rizzardi ..... 206/222
5,038,951 A * 8/1991 Rizzardi ..... 206/222
5,543,097 A * 8/1996 Fang ..... 206/222
5,782,345 A * 7/1998 Guasch et al. ..... 206/222
6,053,314 A * 4/2000 Pittman ..... 206/366
6,148,996 A * 11/2000 Morini ..... 206/222

* cited by examiner

*Primary Examiner*—Luan K. Bui
(74) *Attorney, Agent, or Firm*—Malin, Haley & DiMaggio, P.A.

(57) ABSTRACT

A two piece sealed capsule that is inserted into a liquid bearing container including but not limited to the neck of a bottle, said capsule being a container or receptacle for sealably containing a liquid and/or dry material and a dispenser for releasing the material when desired into the container. The top of the capsule is depressed manually forcing two or more blade like prongs against the bottom of the capsule ripping a portion away, dispensing the material. The present invention allows the use of materials that would discolor, degrade or interact with other substances when added to the contents of the bottle, to remain stable and/or inactive until the time of use.

2 Claims, 5 Drawing Sheets

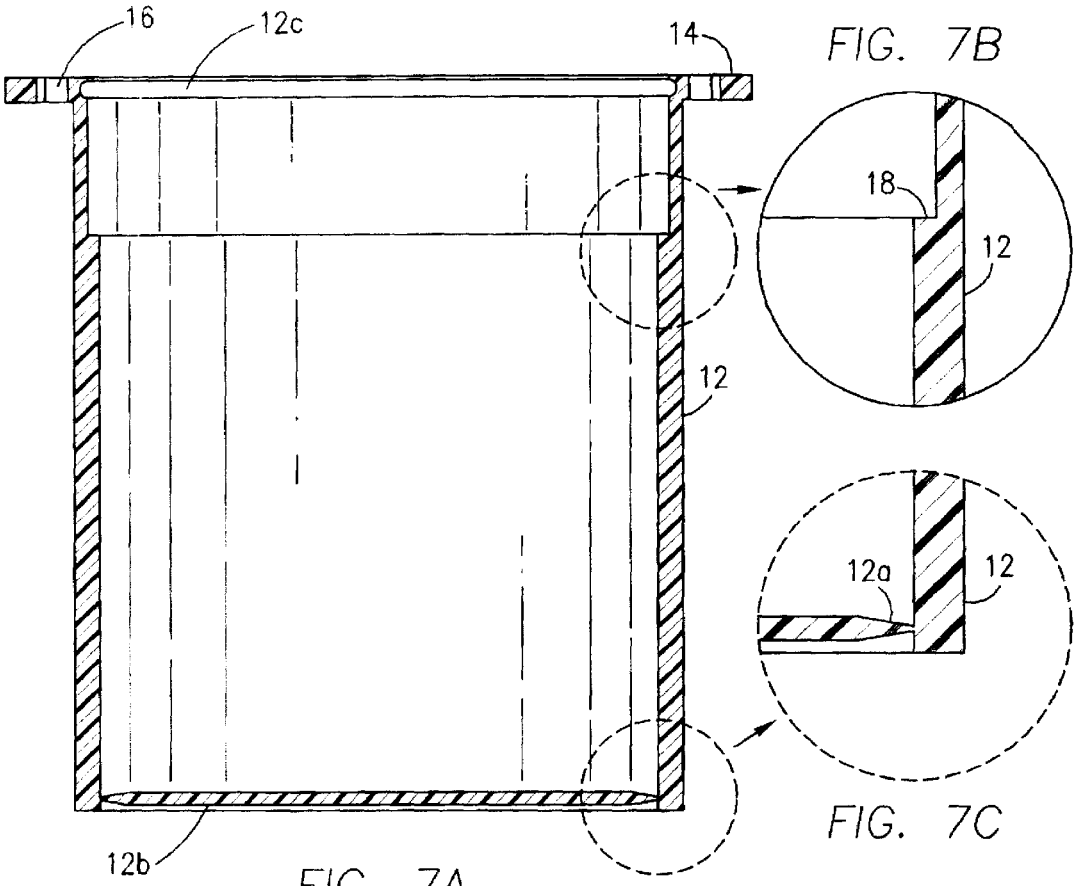
FIG. 7B
FIG. 7C
FIG. 7A
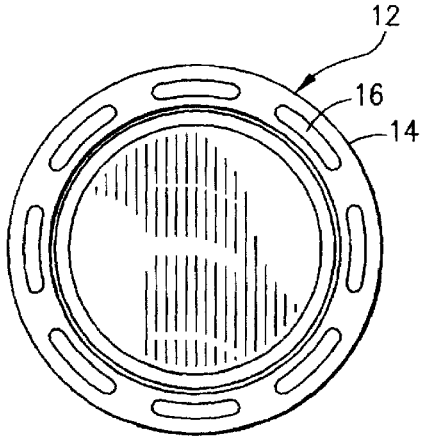
FIG. 8
FIG. 9
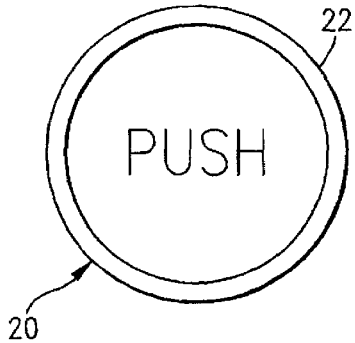

DISPENSING CAPSULE FOR A LIQUID CONTAINER

This is a CIP of application Ser. No. 10/155,461, filed May 24, 2002, now U.S. Pat. No. 6,644,471.

BACKGROUND OF INVENTION

1. Field of the Invention

This invention relates to a liquid and/or dry ingredient dispensing capsule that is utilized with a bottle, pack, pouch, carton, can or any other liquid container or into the cap or any other area of the container. The capsule stores liquid and/or dry substances which can be rapidly dispensed into the container by manual activation when desired and thereafter readily consumed by the user. The capsule may be pre-mounted in the container at the factory after the container itself is partially filled with a liquid or used with an existing container. A conventional container closure or cap is used to seal the container contents, including the capsule. The capsule can be sold separately or prepackage in the beverage container.

2. Description of the Prior Art

Many foods, drugs, cosmetics, adhesives, polishes, cleansers, dyes and other substances are frequently supplied in liquid, powder or crystal form and do not retain their stability, strength and effectiveness for long after they have been mixed in solution or suspension with a different liquid. This incompatibility after mixing therefore mandates that the product be utilized relatively soon after mixture to prevent loss of effective strength, deterioration, discoloration, interactions and the like. It is also important that admixtures of various ingredients be done under conditions wherein a measured amount of one ingredient is added to a measured amount of the other chemical to insure that proper results are obtained. The process of loss of effectiveness is often termed "shelf life." Once two different chemicals are combined, the process of deterioration often begins.

Another concern involves merchandising of certain products, where it is frequently desirable to supply two companion products to the consumer in a single package. Thus, many products are, by their very nature, required to be used by the consumer shortly after their manufacture as they lose certain desirable characteristics with a short period of time, yet the product can be stored for extended periods of time if one ingredient is maintained separate from the other. In such case, the two ingredients may be mixed together to form the desired product shortly before use. In marketing such goods, it obviously is desirable that both ingredients be sold as part of the same package. From an aesthetic as well as a handling standpoint, it is desirable that but a single package be utilized for maintaining such compounds separated.

The use of conventional liquid containers such as plastic bottles for carrying water, juices, power drinks and other desirable liquids for human consumption is quite well known. There are, however, several non-active and active substances such as activated oxygen, vitamins, minerals, herbs, nutrients and flavors that would be desirable to be added to liquids such as water, juices or other beverages to give the consumer added benefits, particularly those useful for the health of the consumer. Many of the substances, however, that provide additional benefits when mixed into another liquid have short shelf lives, discolor, interact or degrade quickly when combined with liquids or other substances. Therefore, many beverages are currently sold without the added beneficial ingredients.

It is known in the art to provide dispensers containing a concentrate of soluble materials to a fixed quantity of solute, usually water, for dispensing. Thus, the prior art teaches containers for beverages wherein the interior of the container is divided into a compartment having a basic ingredient and a compartment which can be ruptured so as to mix, within the container the basic ingredient and some form of modifier, diluent or flavoring. The basic reason for this prior art container is to provide the mixing action at the time of consumption since prior mixing would have adverse effects. The basic ingredient is often not suitable for consumption by itself and requires mixing with a diluent/modifier prior to consumption.

Prior art intra-container mixing prior to use was disclosed in U.S. Pat. No. 5,370,222 to Steigerwald comprising an open threaded container containing a liquid, a powder containing releasable receptacle sealed with foil which is cut by a cutting mandrel during screwing of the receptacle onto the container. Unlike the present invention, the Steigerwald arrangement situates a powder containing receptacle on top of rather than within the container and utilizes a cutting means rather than a two-part sealed plunger means to confine then discharge the receptacle contents.

U.S. Pat. No. 5,863,126 to Guild discloses a baby bottle fluid mixing system comprising a pre-stored powdered substance confined within a first upper container screw disposed atop a second lower container separated by an internal stemmed disk sealed in a snap fit arrangement at the aperture between the bottles, which descends into the lower bottle after removal from the aperture for use. The present invention discloses a capsule body insertable in but not screwed onto a liquid containing bottle and further comprises two sealable plugs or closures rather than one snap fit plug and a disposable, non-reusable interior mounted capsule versus top threaded reusable upper container for pre-stored dry or liquid.

Another such device for separate storage and subsequent mixing of two products was disclosed in U.S. Pat. No. 5,246,142 to DiPalma which comprised a first ingredient container, a second ingredient dispenser compartment plunger arrangement with a weakened wall region inserted within and separated from the container, a removable container closure connected to the plunger and a plunger projection for engagement which ruptures the weakened wall region to release the second ingredient into the first ingredient container. Unlike the present invention, DiPalma's singular sealing means is the reservoir for the second ingredient and fails to create upon activation an orifice for immediate dispensing of the mixed products.

U.S. Pat. No. 5,692,644 to Gueret discloses a container separately storing, then mixing and dispensing two products in which a first liquid containing bottle is separated by a movable wall from a second reservoir containing powder. Force applied to a cylindrical piston in the direction toward the dispensing orifice of the container cuts the seal between the two reservoirs, thereby facilitating the combination and mixing of the two products within the first reservoir of the container. The Gueret apparatus differs from all embodiments of the present invention in that the piston is an integral portion of the slideable base which is snapably attached to the bottle and when compressed with external manual pressure breaks the seals, pushing the contents up into the bottom portion of the liquid-containing bottle thereby accomplishing the mixing of the two products and simultaneously reducing the exterior dimensions of the bottle. The present invention dispenses the dry product without a piston or slideable base integrated within the bottle nor does the overall size of the bottle change during use.

Another separate storage and dispensing device was disclosed in U.S. Pat. No. 4,638,907 to Morane which comprised a bottle for liquid having at its neck a leak proof envelope separately storing and enclosing additional product, with a slidable push button perforator in the cap on the bottle neck which opens the envelope to discharge the envelope contents into the liquid in the bottle, thereafter being dispensed through a duct in the cap rather than passing through the perforated center cap area as is the case with the present invention. Morane is also not a two plug system as is the present invention.

The present invention provides a liquid and/or dry ingredients containing capsule that is inserted into any type liquid container including packs, bags, cans and plastic or glass bottles. With a bottle as an example, the capsule may be mounted typically within the neck or throat of a liquid container having a conventional screw off cap, such as a bottle of water. The capsule includes a manual dispenser. The capsule ingredients are completely sealed within the capsule body, and remain separated from the liquid in the bottle until the exact moment of usage, which is determined by the consumer by manually dispensing the capsule ingredients (powder or liquid). The capsule can also be conveniently mounted in the throat of the bottle or within/under a standard prior art pull-up liquid dispenser cap without interfering with the sealing of the bottle itself in its normal capping operation. The capsule can be mounted to or within any type of package or carton through the package wall at any location. Thus, active ingredients, e.g. activated oxygen, vitamins, herbs, nutrients or other substances having a short activity life (shelf life) when added to a particular liquid can now be safely and sealably stored in a capsule until time for use and can be subsequently added to the desired liquid, thereby ensuring that the shelf life and time of activity of the materials are not jeopardized even though they are housed within the liquid container.

The present invention also offers the advantage that it does not require significant modification of existing liquid containers, packages, cartons, bottle caps or existing bottles. In fact, it can be inserted into existing bottles without interfering with the sealability of the conventional bottle and bottle cap.

None of the above prior art taken either alone or in combination, describes, suggests or renders obvious the instant invention as claimed.

SUMMARY OF INVENTION

A dispensing capsule for sealably containing a liquid and/or powder materials having substantially a cylindrical liquid impervious body of any size or shape but for many cartons, packages and bottle liquid containers, sized in diameter to fit within the inside diameter of a neck or any other location of the bottle, can, carton, pouch, and the like. The capsule is comprised of two interlocking members that form a sealed capsule.

The first member is a cylinder having a sealed closed end and an open end surrounded by an extended annular lip having a plurality of apertures that extend beyond the cylinder wall exterior. The first member inside cylinder wall can have an annular flange below the top opening. The first member is made of a liquid impervious material such as plastic, polypropylene or polyethylene but not limited thereto. Other materials are suitable. However, the first member could also be made of metal, glass or fabric. The bottom end wall of the first member is integrally molded with the cylinder wall as a single piece with the bottom end wall having a thinner annular area near its perimeter to act as a weakened fungible bottom end cap that can be partially severed by a plunger described below.

The second capsule member is a cylinder having an open bottom end and a sealed closed top end. The outside diameter of the second member is less than the inside diameter of the first member, such that the second member fits inside the first member and can be pushed as a plunger. The perimeter defining the bottom open end of the second member cylinder formed by the cylinder wall is irregularly shaped having two or more spaced apart prong like pointed areas farther from the closed end. The top closed end wall of the second member forming the top of the capsule has a sealing extended lip that engages the first member inside wall groove to seal the first member to the second member.

In the preferred embodiment of the invention, the second member sealably fits inside the first member with a liquid or powder inside. Since both the first member and the second member are liquid impervious and the second member includes an annular lip at its closed end which is the top of the capsule in the operating position and the first member has an inside groove near the top of its open end, the first and second members are joined together at the factory after the ingredients which are to be dispensed are first loaded into the first member. The ingredients can be liquid or granular or powder like and are placed in the first member at the factory. With the ingredients in place, the second member is inserted and fits inside the first member containing the ingredients and is pushed downwardly until the annular lip on the closed end of the second member engages a groove that seals it tight in the inside wall of the first member. Thus, the final capsule has a closed top and a sealed bottom that act as a unit.

The entire capsule which includes the extended annular lip around the first member may be inserted into the wall of a carton, package, flexible container, the neck of a bottle or a liquid package which could also be at the factory. As an example, a bottle of water could have the capsule inserted in the neck and then the cap sealed tightly thereon. The capsule could also be attached through a carton or flexible liquid package in a sealed connection through the wall.

At the time of use, the capsule top can be depressed forcing the second member downwardly manually until the extending prongs and knife like surface along the perimeter of the open end of the second member engage the weakened area around the perimeter of the first member base or bottom ripping and tearing away portions of the first member base or bottom causing the contents liquid or powder to be quickly dispensed by gravity into the liquid in the bottle which in this example is water. The different types of chemicals and uses is extensive. Packages for hair coloring, kitchen foods such as steak and marinate or herbs, automotive products and oral tooth care products are a few that may require use of two chemicals that must be separated until actual use.

Once the ingredients are thoroughly mixed with the liquid in the bottle, the user can drink directly from the bottle inasmuch as the liquid will flow out of the bottle through the apertures disposed in the outer perimeter lip of the first member. Note that the first member interior wall also includes a flange about a third of the way down from the top that engages the lip of the second inner member preventing the second inner member from being plunged or forced into the bottle of liquid.

One of the advantages of the present invention is that it does not require additional thin foil seals at either end. The capsule once it is sealed at the factory is self-contained and can be sold independently and later put into a liquid bottle, pouch, carton, jug, can or the like or can be added at the factory when the liquid is added to the bottle. The purpose of having a separate container is to extend the shelf lives of the combined ingredients contained within the capsule. Many ingredients have a short shelf life once added to a liquid such as water or other drink. By having the individual capsules that are completed sealed until the time of use the active ingredients can be kept separate from the main ingredient such as the liquid in the bottle, carton, package or container.

In an alternate embodiment of the invention, the second member closed end could be modified to have a center hole sealed by a removable foil having adhesive. The first member upper perimeter lip apertures would no longer be necessary to permit the user to pour the mixed ingredients out of the container or drink from the container. Liquid would flow through the hole in the second member once the first member bottom cap is ruptured.

It is an object of the invention to provide an insertable capsule that includes active ingredients that can be readily dispensed into any type of container housing a second material at a desired time, thus not interfering with the shelf life or physical/chemical integrity of the ingredients to be combined.

It is an object of this invention to provide a liquid and/or dry ingredient bearing receptacle that includes a dispenser to allow consumers to dispense the liquid or powder into the liquid bearing container, pouch, package, carton at any time, the capsule being housed within the liquid containing container in a sealed condition.

Still another object of this invention is to provide for sanitary release of the desired ingredients from a capsule of any size or shape into a liquid-containing package at a time selected by the consumer.

In accordance with these and other objects which will become apparent hereinafter, the instant invention will now be described with particular reference to the accompanying drawings.

BRIEF DESCRIPTION OF DRAWINGS

FIG. 7A is a front elevational view of the first member of the present invention included with dotted lines.

FIG. 7B is a cutaway portion showing a wall segment of the figure shown in FIG. 7A in a side elevational view and cross section partially cutaway.

FIG. 7C is a partially cutaway side elevational view and cross section of the body edge area shown in FIG. 7A.

FIG. 8 is a top plan view of the first member of the present invention.

FIG. 9 is a top plan view of the second member of the present invention.

DETAILED DESCRIPTION

Figure 1:
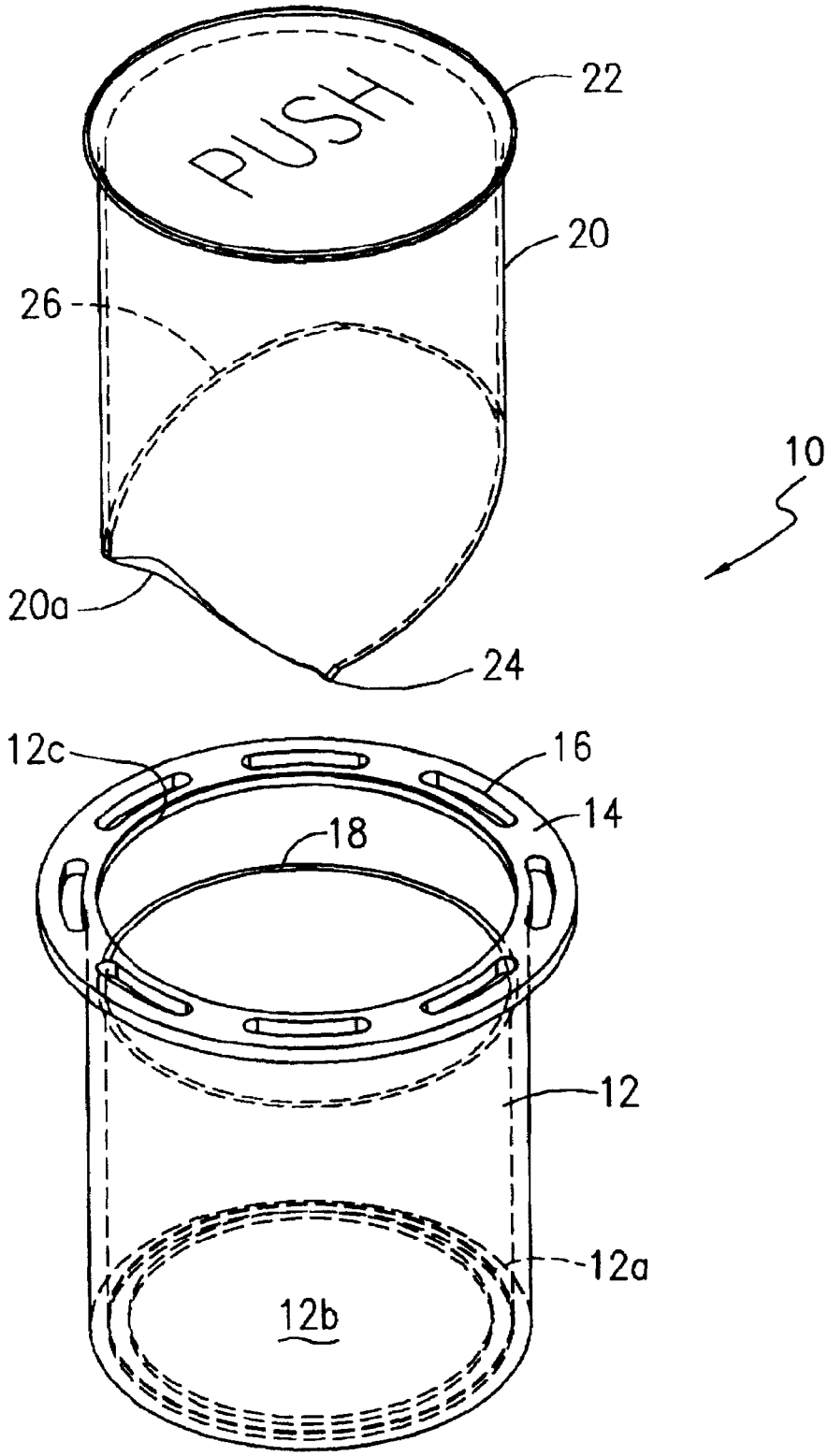
FIG. 1 shows an exploded perspective view of the present invention.

Referring now to the drawings and in particular FIG. 1, the present invention is shown in FIG. 1 at 10 comprised of a first cylindrical water impervious plastic member 12 having a cylindrical body that includes a sealed bottom 12*b* that is integrally formed with the cylinder 12 through a weakened wall area 12*a* which defines the perimeter of the bottom of the first member 12. The top extended lip 14 is annular around the top opening of the cylinder 12 and includes a plurality of apertures 16 disposed around the perimeter that extend beyond the inside wall of the first member cylinder 12. The interior of first member 12 includes an extended lip 18 that prevents the second member 20 from being pushed beyond the upper lip 22 when the second member 20 is inserted at the factory into first member 12. The annular lip which extends inwardly 18 on the inside wall of cylinder first member 12 is a stop when the device is activated by depressing the second member 20 downwardly to puncture the bottom wall 12*b* of first member 12 to dispense the ingredients. Lip 22 on member 20 prevents the entire element 20 from being pushed into a liquid in the bottle because of lip 18. However, the inside wall of first member 12 also includes a groove 12*c* that engages lip 22 to seal the unit at the factory.

Figure 2:
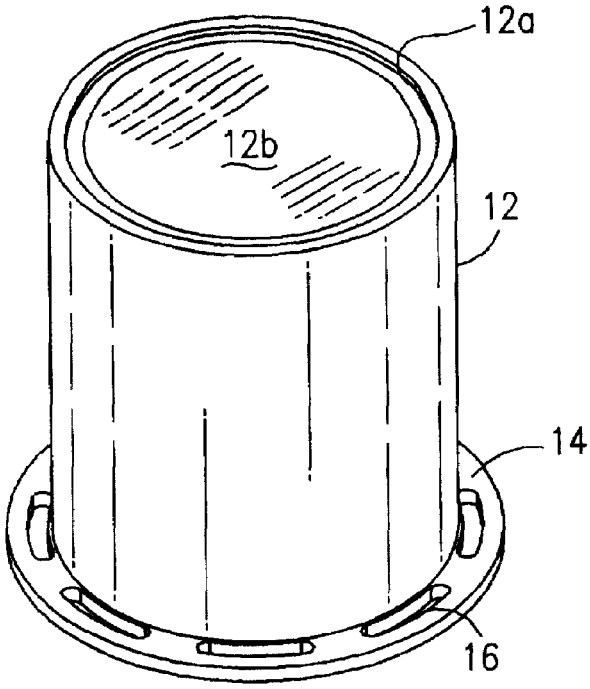
FIG. 2 shows a perspective view of the first member inverted of the present invention.

Referring now to FIG. 2, the first member is shown inverted in order to show the perimeter area near the bottom 12*b* that has the weakened area 12*a* which allows the pointed prongs 24 and 26 on the second member to sever areas of the bottom 12*b* from the first member cylindrical body 12 which allows the ingredients to be dispensed into a bottle. Additional prongs could be added on either side of prong 24 and prong 26. The annular lip 14 extends beyond the outside wall of first member cylinder 12 so that it holds the entire capsule inside a bottle neck or carton without falling through into the container. Thus, the capsule in accordance with the invention is sized so that the outside diameter of the first member 12 is smaller to fit into a conventional carton, package, and water bottle while at the same time the annular peripheral lip 14 is larger in diameter and can fit across the top of a package opening and bottle neck and be larger than the inside diameter of the bottle neck so that the entire capsule sits on top of the bottle at the bottle neck.

Figure 3:
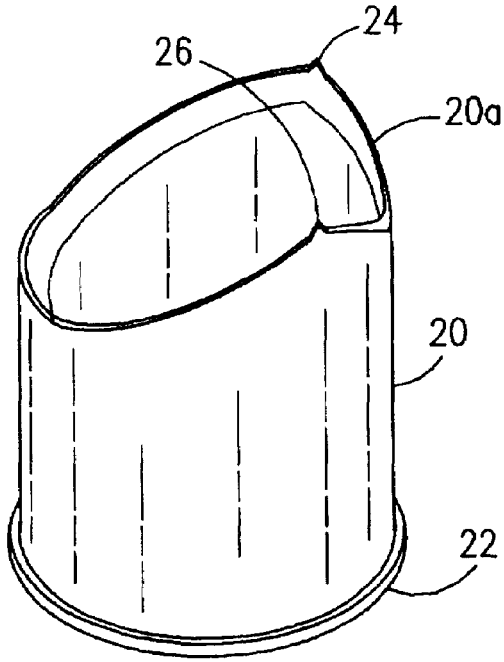
FIG. 3 shows a perspective view inverted of the second member of the present invention.

Referring now to FIG. 3, the plunger is shown which is the second member 20 that includes pointed segments on the bottom edge of the plunger along peripheral 20*a* which is irregular to allow the plunger 26 and 24 to separate the weakened areas on the bottom wall of the first element 12 shown in FIG. 2. The second element 20 also has an extended lip 22 that is explained greater detail below. Note that the peripheral edge surrounding the bottom of the second member 20 which is also called the plunger may have tapered portions 20*a* that acts somewhat like a knife blade for cutting purposes.

Figure 6:
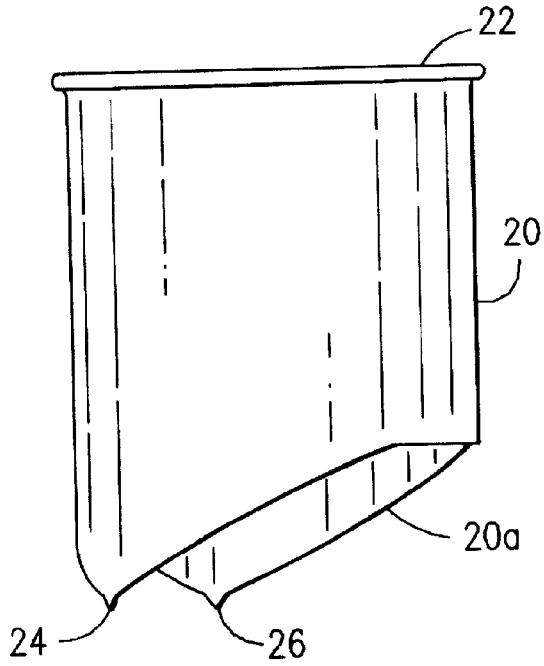
FIG. 6 is a side elevational view of the second member of the present invention. The opposite side view would be a mirror image thereof.
Figure 5:
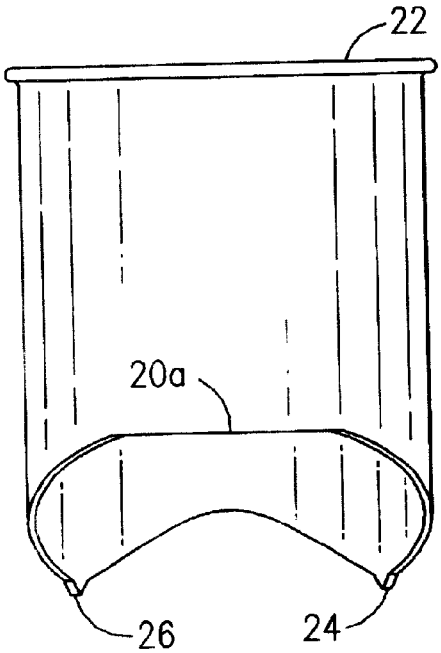
FIG. 5 is a rear elevational view of the second member of the present invention.
Figure 4:
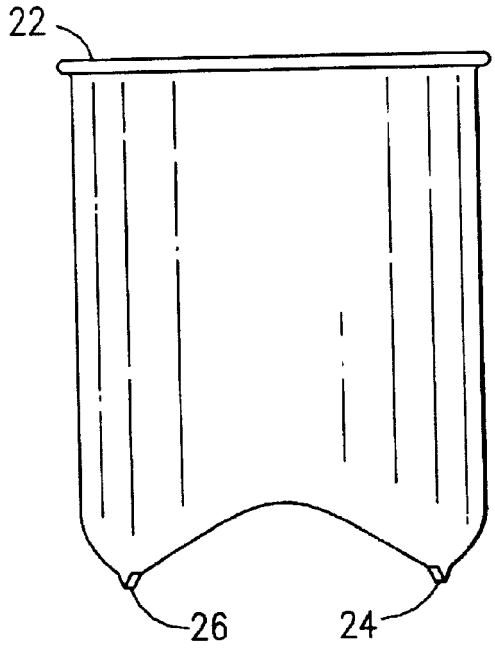
FIG. 4 is a front elevational view of the second member of the present invention.

Referring now to FIGS. 4, 5 and 6, the plunger is shown including its peripheral lip 22 which is also formed part of the sealed top of the cylinder and the irregular base edge 20*a* which includes two pointed prongs spaced on one side of the unit. FIG. 5 shows the back wall portion 20*a* which is narrower relative to lip 22 than the extended prongs 24 and 26 which extend well beyond the back of the plunger. Although two prongs that are quite pointed 24 and 26 are shown as part of the plunger, additional prongs spaced appropriately can be used. The reason that the distance is from the prongs are spaced to extend beyond the bottom wall edge 20*a* is to peal back the weakened portion on one side to allow the bottom of the first unit to tear away partially (up to about 90 percent of the perimeter can be severed) while still remaining attached on the far side. In other words, the entire weakened portion of the bottom floor of element no. 1 is not completely severed from the first member 12 but remains in tact because the prongs do not cut the entire perimeter on the inside of the bottom wall 12*b*. It is important that the bottom first wall of member 12 not be completely severed in that it would fall into the liquid interfering with consuming the liquid.

Referring now to FIG. 7A, the first member 12 is shown having wall portions that are explained as follows. FIG. 7B shows the inside wall of element 12 including an inwardly extending lip around the entire inside of first member 12. The purpose of lip 18 is to engage the upper extended lip of the second element along its top so that it does not fall through when it is depressed to dispense the ingredients therein. Lip 18 prevents the extended lip 22 from allowing the entire plunger to pass through first member 12.

Referring now to FIG. 7C, the weakened area 12*a* which is around the entire periphery of the base 12 shows a tapered area that engages the prongs in the second member 20 when the plunger is depressed ripping portions of the base away. This happens in the tapered area 12*a*.

FIG. 8 shows a top view of first member 12 that includes the extended peripheral lip 14 that has the aperture 16 which allow liquid to flow through from the bottle into the user's mouth out through the neck of the bottle even if the capsule is retained in the water bottle. The aperture 16 in the extended lip on 12 are thus for drinking purposes to allow the flow of liquid out of the bottle after it has been mixed.

FIG. 9 shows a top plan view of the plunger 20 including the lip 22.

Figure 10:
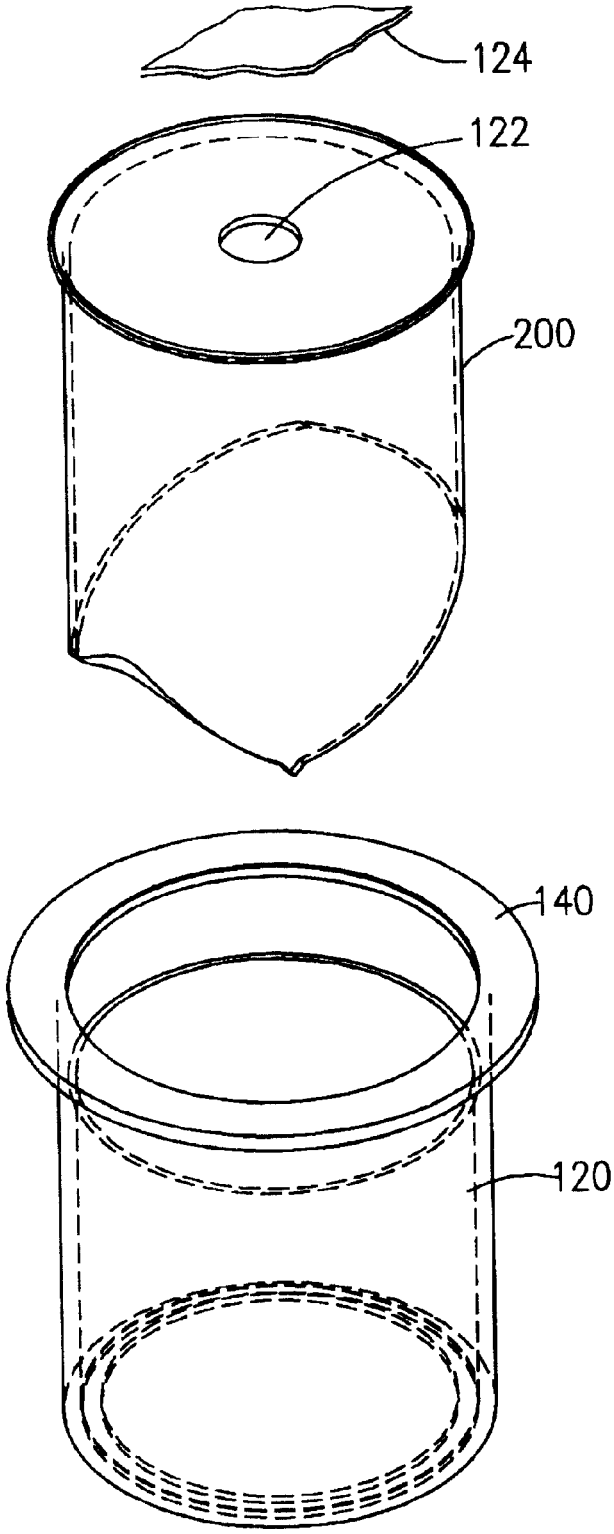
FIG. 10 is a perspective view, exploded of an alternate embodiment of the invention.

FIG. 10 shows an alternate embodiment of the invention in that the plunger 120 has hole 122 for liquid to flow through without using apertures 16 (FIG. 1). The hole 122 can admit a straw or be used to pour liquid from the container once the plunger 120 has been activated. A foil cover and tab 124 seals the hole 122 with appropriate liquid impervious material and adhesive that can be removed when the capsule is activated.

In operation referring back to FIG. 1 at the factory, the first member 12 is a separate unit from the second member 20. The first member 12 is filled with a liquid or powdered ingredient up to a certain portion or level. The second element 20 is then strategically positioned inside element 12 with the upper lip 22 engaging a groove 12*c* in the first member 12 sealing the ingredients therein and engaging the first member 12 into a sealed relationship with the second member 20. The length of second element 20 is such that the prongs 24 and 26 do not engage base 12*b* in the storage position. The capsule in this condition is then preferably placed into a liquid container such as a bottle that has a bottle neck or it fits across the top of the bottle neck such that lip 14 on element 12 rests on top of the edge of a bottle top opening above the threads so the entire does not fall into the bottle of liquid. This can also be sealed at the factory.

When it comes time to use the ingredients, the user would take off the bottle cap and manually push on the top of element 2 forcing the plunger downwardly such that pointed prongs 24 and 26 start tearing around the peripheral of the bottom floor of element 12. When this is ripped partially away along one half of the container wall, the ingredients will be dispensed by gravity into the liquid in the liquid container. Once the ingredients are mixed with the liquid, the user can then drink directly from the bottle and the interior liquids that have been mixed will flow through aperture 16 into the user's mouth. When the entire contents have been consumed, the user can put the bottle cap back on the bottle and discard both the bottle and the capsule.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A capsule that contains liquid and/or dry material to be subsequently dispensed into a container comprising:

a capsule body that is impervious to liquid;

said capsule body, including a first member and a second member, said second member mountable in said first member;

said capsule first member body having a top opening and a sealed closed bottom;

said capsule second member having a sealed closed top and an open bottom and a cutting element defining the open bottom, said cutting element further including a first prong and a second prong disposed along the peripheral edge of the second member bottom and having a cutting edge disposed between said first prong and said second prong, said first prong and said second prong being disposed below an opposite bottom edge and forming the lower portion of said bottom edge whereby said first member can be moved relative to said second member such that the second member will cut open the sealed closed bottom of said first member; and said first and second members in a first mode are sealed forming said capsule body preventing any liquid or dry material from escaping from the capsule body; and said first member having a peripheral lip with apertures that extends radially outward from said first member top opening.

2. A capsule that contains liquid and/or dry material to be subsequently dispensed into a container comprising:

a capsule body that is impervious to liquid;

said capsule body, including a first member and a second member, said second member mountable in said first member;

said capsule first member body having a top opening and a sealed closed bottom;

said capsule second member having a sealed closed top and an open bottom and a cutting element defining the open bottom, said cutting element further including a first prong and a second prong disposed along the peripheral edge of the second member bottom and having a cutting edge disposed between said first prong and said second prong, said first prong and said second prong being disposed below an opposite bottom edge and forming the lower portion of said bottom edge whereby said first member can be moved relative to said second member such that the second member will cut open the sealed closed bottom of said first member; and said first and second members in a first mode are sealed forming said capsule body preventing any liquid or dry material from escaping from the capsule body; and said second member having a hole in said closed end and removable sealing means covering said hole.

* * * * *